US007144228B2

(12) United States Patent
Emmer et al.

(10) Patent No.: US 7,144,228 B2
(45) **Date of Patent: *Dec. 5, 2006**

(54) CRYOGENIC FLUID DELIVERY SYSTEM

(75) Inventors: Claus Emmer, Prior Lake, MN (US); Thomas K. Drube, Lakeville, MN (US); Jesse Gamble, Minneapolis, MN (US)

(73) Assignee: Chart Industries, Inc., The Woodlands, TX (US)

( * ) Notice: Subject to any disclaimer, the term of this patent is extended or adjusted under 35 U.S.C. 154(b) by 589 days.

This patent is subject to a terminal disclaimer.

(21) Appl. No.: 10/601,458

(22) Filed: Jun. 23, 2003

(65) Prior Publication Data

US 2004/0055316 A1 Mar. 25, 2004

Related U.S. Application Data

(63) Continuation-in-part of application No. 10/054,784, filed on Oct. 29, 2001, now Pat. No. 6,581,390.

(51) Int. Cl.
*F04B 17/00* (2006.01)
*F17C 13/00* (2006.01)

(52) U.S. Cl. ..... 417/398; 62/50.6

(58) Field of Classification Search ..... 417/398, 417/397, 399, 401, 403, 404, 374, 379, 390, 417/901; 62/50.6

See application file for complete search history.

(56) References Cited

U.S. PATENT DOCUMENTS

| | | | | |
|---|---|---|---|---|
| 1,790,203 | A * | 1/1931 | Ekstromer | 417/238 |
| 3,234,746 | A * | 2/1966 | Cope | 62/50.6 |
| 4,441,862 | A * | 4/1984 | Vogel | 417/250 |
| 5,411,374 | A | 5/1995 | Gram | |
| 5,687,776 | A | 11/1997 | Forgash et al. | |
| 5,771,946 | A | 6/1998 | Kooy et al. | |
| 5,787,940 | A | 8/1998 | Bonn et al. | |
| 5,884,488 | A | 3/1999 | Gram et al. | |
| 6,210,131 | B1 * | 4/2001 | Whitehead | 417/397 |

* cited by examiner

*Primary Examiner*—Anthony Stashick
*Assistant Examiner*—Vikansha S. Dwivedi
(74) *Attorney, Agent, or Firm*—DLA Piper US LLP; R. Blake Johnston

(57) ABSTRACT

A cryogenic fluid delivery system includes a pump having a pumping cylinder within which a sliding pumping piston is positioned. The pump also includes an actuating cylinder within which a sliding actuating piston is positioned and a supplemental linear actuator, such as a hydraulic cylinder. The pumping and actuating pistons and supplemental linear actuator are joined by connecting rods. A portion of the cryogenic liquid pumped from a storage tank is vaporized in a heat exchanger and introduced into the actuating cylinder to power the pump with the assistance of the supplemental linear actuator so that high pump discharge pressures may be obtained.

20 Claims, 4 Drawing Sheets

406a
414a
102
418a
402
408
20
410
404
420
406b
82
412
418b
86
414b
74a
23
76a
72
26
24a
88
84
106
68
416
24b
76b
92
75
74b
14
22
38
42a
66
32
16
42b
34
48a
35
52a
36a
46a
12
54a
10
56
44
64
36b
46b
58
54b
30
48b
52b
94
62
104

CRYOGENIC FLUID DELIVERY SYSTEM

CLAIM OF PRIORITY

This application is a continuation-in-part of U.S. application Ser. No. 10/054,784, filed Oct. 29, 2001, now U.S. Pat. No. 6,581,390.

BACKGROUND OF THE INVENTION

The invention relates generally to cryogenic fluid delivery systems, and, more particularly, to a cryogenic fluid delivery system that vaporizes a portion of a pumped cryogenic liquid stream and uses the vaporized cryogen to power a linear actuator which, in combination with a supplemental linear actuator, drives the system pump.

Cryogenic fluids, that is, fluids having a boiling point generally below −150° F. at atmospheric pressure, are used in a variety of applications. For example, liquid natural gas (LNG) is an alternative fuel for vehicles that is growing in popularity. As another example, laboratories and industrial plants use nitrogen in both liquid and gas form for various processes.

Cryogenic fluids are typically stored as liquids that require pressurization and sometimes heating prior to usage. The liquid nitrogen stored by laboratories and industrial plants typically must be pressurized prior to use as a gas or liquid. In the case of LNG fueling stations, the LNG is typically dispensed to a vehicle in a saturated state with a pressure head that is sufficient to meet the demands of the vehicle's engine. The saturated state of the LNG prevents the collapse of the pressure head while the vehicle is in motion. Alternatively, the LNG may be stored onboard a vehicle in an unconditioned state. The onboard LNG may then be pressurized and heated as it is provided to the vehicle engine.

A common method of saturating the LNG is to heat it as it is stored in a delivery system storage tank. This is often accomplished by removing a quantity of the LNG from the tank, warming it (often with a heat exchanger) and returning it to the tank. Alternatively, the LNG may be heated to the desired saturation temperature and pressure through the introduction of warmed cryogenic gas into the tank.

Warming LNG in the delivery system tank is undesirable, however, because it reduces the hold time of the tank. The hold time of the tank is the length of time that the tank may hold the LNG without venting to relieve excessive pressure that builds as the LNG warms. Furthermore, refilling a tank when it contains saturated LNG requires specialized equipment and additional fill time. Warmed LNG also is less dense than cold LNG and thus reduces tank storage capacity. While these difficulties may be overcome by providing an interim transfer or conditioning tank, such tanks have to be tailored in dimensions and capacities to specific use conditions. Such use conditions include the amount of fills and pressures expected. As a result, the variety of applications for such a delivery system are limited by the dimensions and capacities of the conditioning tank.

Another approach for saturating the LNG prior to delivery to the vehicle tank is to warm the liquid as it is transferred to the vehicle tank. Such an approach is known in the art as "Saturation on the Fly" and is illustrated in U.S. Pat. No. 5,787,940 to Bonn et al. wherein heating elements are provided to heat LNG as it is dispensed. A disadvantage of the system of the Bonn et al. '940 patent, however, is that electricity is required to operate the heating elements. In addition, the system of the Bonn et al. '940 patent employs a conventional pump and thus suffers from initial system, operating and maintenance cost disadvantages.

U.S. Pat. No. 5,687,776 to Forgash et al. and U.S. Pat. No. 5,771,946 to Kooy et al. also illustrate systems that dispense cryogenic fluid and perform saturation on the fly. The systems disclosed in these two patents use heat exchangers, and therefore ambient temperature, to warm the cryogen as it is transferred to vehicles. The systems, however, also use conventional pumps to dispense the cryogen.

Prior art cryogenic fluid delivery systems typically pressurize and transport the cryogen via pumps that are powered by electricity or-mechanically with fuels such as gas or oil. This significantly increases the operating costs of the delivery system. In addition, many prior art cryogenic fluid delivery systems use pumps that are of the centrifugal or "single-acting" piston variety. Single-acting piston pumps have a single chamber in which an induction stroke of the piston is followed by a discharge stroke. A disadvantage of such pumps is that they have relatively low pump delivery rates which results in increased fueling times.

In answer to the above concerns, some prior art pumps are powered by a "dual-acting" piston that is driven by pressurized gas or liquid. For example, U.S. Pat. No. 3,234,746 to Cope discloses a pump for transporting liquid carbon dioxide from a storage tank. The pump is powered by carbon dioxide vapor from the head space of the storage tank. The pump of the Cope '746 patent features two pistons and corresponding cylinders with a common piston rod. Carbon dioxide vapor is provided to opposing sides of the driving cylinder in an alternating fashion so that the other piston is driven. As a result, the driven piston pumps the liquid carbon dioxide in the tank to a second tank or container. The driven piston is dual-acting so that it pumps the liquid carbon dioxide from both sides of the piston, that is, liquid carbon dioxide is pumped during every stroke of the piston. Carbon dioxide vapor exhaust from the driving cylinder is vented to the atmosphere.

While the pump of the Cope '746 patent is inexpensive to operate, the transfer rate and discharge pressure that it may achieve is limited by the pressure that is available in the head space of the storage tank. In addition, the liquid carbon dioxide in the storage tank must be warmed for the pump to operate. As described previously, warming the liquid carbon dioxide, or any cryogenic liquid, reduces the hold time of the tank. The pump of the Cope '746 patent also fails to provide a means for heating the liquid carbon dioxide as it is transferred.

In response to the limitations in delivery rates of prior art pumps, the pump illustrated in U.S. Pat. No. 5,411,374 to Gram was developed. The Gram '374 patent features a dual-acting piston arrangement that is similar to the pump of the Cope '746 patent. The pump of the Gram '374 patent, however, is powered by a hydraulic motor circuit which provides liquid to opposing sides of the driving piston in an alternating fashion. While the pump of the Gram '374 patent overcomes the discharge pressure shortcomings of the pump of the Cope '746 patent and the prior art, the hydraulic motor circuit provides for significantly increased operating costs.

An additional problem with the pump of the Gram '374 patent, and other pumps that use linear actuators, such as hydraulic cylinders, is that when the discharge pressure of the pump gets high, such as 3000 psi or greater, the size of the actuator becomes very large. Indeed, the size of the actuator may become even larger than the remaining portion of the pump. Such an arrangement is impractical from a production and operation standpoint.

As explained in commonly owned U.S. patent application Ser. No. 10/054,784 to Emmer et al., a low pressure cryogenic liquid may be pumped to a higher pressure and then a portion of the liquid may be vaporized with an ambient air heat exchanger. The resulting gas may then be used to power the piston of a linear actuator which drives the pump. The expansion ratio between the liquid and gas phases is considerable. As the discharge pressure of the pump increases, however, the expansion ratio between the liquid and gas phases becomes less. As a result, the pump becomes less and less effective as its outlet or discharge pressure increases.

Accordingly, it is an object of the present invention to provide a cryogenic fluid delivery system that provides a high discharge pressure with a minimum consumption of utility power.

It is another object of the present invention to provide a cryogenic fluid delivery system that provides a high discharge pressure with an actuating system that is practical and not oversized.

It is still another object of the present invention to provide a cryogenic fluid delivery system that provides for economical saturation on the fly.

SUMMARY OF THE INVENTION

The cryogenic fluid delivery system of present invention includes a pump having a pumping cylinder that is divided by a pumping piston into first and second chambers, each of which includes an inlet and an outlet. First and second inlet check valves communicate with the inlets of the first and second pumping cylinder chambers, respectively. In addition, first and second outlet check valves communicate the outlets of the first and second pumping cylinder chambers, respectively. The check valves cooperate to permit cryogenic liquid to flow into the first pumping cylinder chamber and out of said second pumping cylinder chamber when the pumping piston moves in a first direction and out of said first pumping cylinder chamber and into the second pumping cylinder chamber when said pumping piston moves in a second direction that is opposite of the first direction. A portion of the cryogenic liquid pumped by the pumping piston travels to a heat exchanger where it is vaporized.

The pump also includes an actuating cylinder that is divided by an actuating piston into first and second chambers, each of which includes an inlet and an outlet. The actuating piston is joined to the pumping piston by a first connecting rod. A first automated control valve is positioned in circuit between the heat exchanger and the actuating cylinder inlets and introduces cryogenic vapor from the heat exchanger into the first and second actuating cylinder chambers in an alternating fashion thereby propelling the actuating piston in the first and second directions in a reciprocating fashion.

A supplemental linear actuator, preferably in the form of a hydraulic cylinder, includes a hydraulic piston attached to the actuating piston with a second connecting rod. First and second chambers are positioned on opposing sides of the hydraulic piston, each of which includes an inlet. A second automated control valve communicates with a pressurized source of hydraulic fluid and the hydraulic cylinder first and second chamber inlets so that hydraulic fluid is introduced into the first and second chambers in an alternating fashion thereby propelling the hydraulic piston in the first and second directions in a reciprocating fashion.

As a result, the pumping piston is also moved in the first and second directions in a reciprocating fashion by both the actuating piston and the hydraulic piston.

Cryogenic vapor exiting the actuating cylinder is directed to a gas and liquid mixer. The portion of the pumped cryogenic liquid that is not vaporized is also directed to the gas and liquid mixer where it is heated by the cryogenic vapor for the actuating cylinder. A pressure control circuit is positioned in the line running from the pumping cylinder outlets to the mixer. The pressure control circuit may be adjusted to increase the pressure within the line so that a greater portion of the pumped cryogenic liquid is vaporized and ultimately directed to said gas and liquid mixer so that greater heating of the cryogenic liquid occurs therein.

The following detailed description of embodiments of the invention, taken in conjunction with the appended claims and accompanying drawings, provide a more complete understanding of the nature and scope of the invention.

DESCRIPTION OF THE PREFERRED EMBODIMENTS

Figure 1:
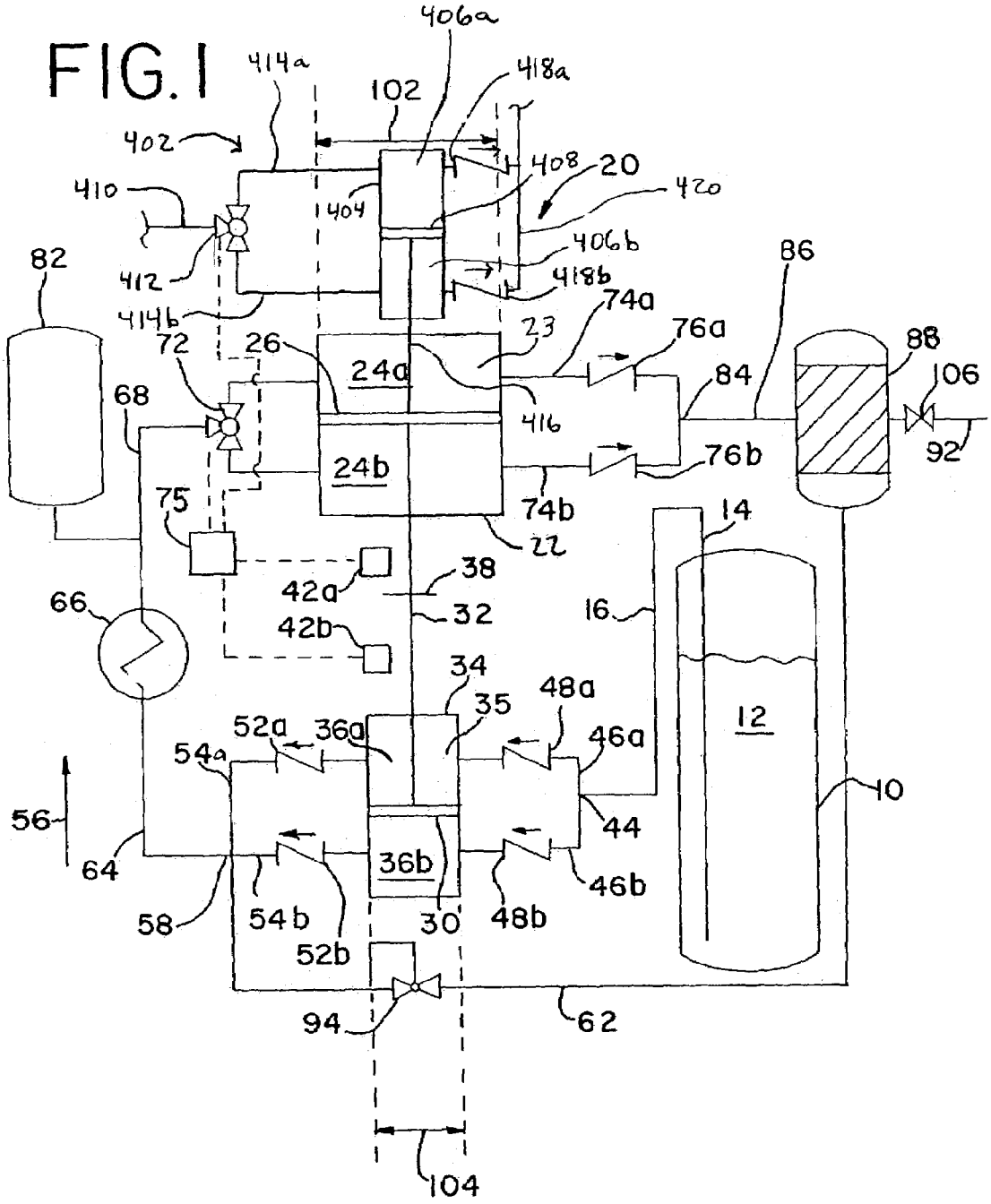
FIG. 1 is a schematic diagram of a preferred embodiment of the system of the present invention.

A preferred embodiment of the cryogenic fluid delivery system of the present invention is illustrated in FIG. 1. It should be noted that, while described below primarily in terms of a liquid natural gas (LNG) dispensing station, the cryogenic fluid delivery system of the present invention may be used in a variety of alternative applications including, but not limited to, an onboard fuel delivery system for vehicle engines and dispensing systems or stations for cryogenic liquids other than LNG such as, for example, pressurized nitrogen.

The system of FIG. 1 includes an insulated bulk storage tank 10 within which a supply of LNG 12 is stored. Suitable bulk storage tanks are well known in the art and are typically jacketed with the space between the tank and jacket evacuated so that vacuum insulation is provided. LNG 12 is withdrawn from the storage tank 10 via dip tube 14 and main inlet line 16.

The pump of the system is indicated in general at 20 in FIG. 1. Pump 20 includes an actuating cylinder housing 22 that defines the actuating cylinder 23. The actuating cylinder is divided into chambers 24*a* and 24*b* by an actuating piston 26. Actuating piston 26 is positioned within the actuating cylinder in a sliding fashion.

Pump 20 also includes a pumping piston 30 that is connected to the actuating piston 26 by connecting rod 32. A pumping cylinder housing 34 defines the pumping cylinder 35 which is divided into chambers 36*a* and 36*b* by the pumping piston 30. Similar to the actuating piston, the pumping piston 30 is positioned within the pumping cylinder in a sliding fashion.

Pump 20 is also provided with a supplemental linear actuator, indicated in general at 402. In FIG. 1, the supplemental linear actuator takes the form of a hydraulic cylinder having a hydraulic cylinder housing 404 that defines a cylinder which is divided into chambers 406*a* and 406*b* by hydraulic piston 408. While a hydraulic cylinder is illustrated in FIG. 1, it should be noted that alternative types of linear actuators may be used instead. These include, but are not limited to, electronic actuators, pneumatic actuators and eccentric cam driven actuators. In addition, the supplemental linear actuator could be positioned in locations other than the one illustrated in FIG. 1. For example, the actuator could be positioned between the pump cold end (pumping housing 34) and the actuating cylinder housing 22 or even on the opposite side of the cold end.

The travel of the hydraulic, actuating and pumping pistons within the hydraulic, actuating and pumping cylinders, respectively, is controlled by stroke change cam 38 and limit switches 42*a* and 42*b*, as will be explained below.

As illustrated in FIG. 1, main inlet line 16 leading from dip tube 14 and tank 10 encounters a junction 44 from which first and second pumping cylinder inlet lines 46*a* and 46*b* extend. LNG entering the first pumping cylinder inlet line 46*a* travels through the first pumping cylinder inlet check valve 48*a* and into chamber 36*a* of the pumping cylinder. Similarly, LNG entering the second pumping cylinder inlet line 46*b* travels through second pumping cylinder inlet check valve 48*b* and into chamber 36*b* of the pumping cylinder. LNG exiting chamber 36*a* travels through first pumping cylinder outlet check valve 52*a* and first pumping cylinder outlet line 54*a*. LNG exiting chamber 36*b* travels through second pumping cylinder outlet check valve 52*b* and second pumping cylinder outlet line 54*b*.

Pumping piston 30 travels up and down in a reciprocating fashion as powered by the actuating piston 26 and hydraulic cylinder 402. As the pumping piston travels upward, in the direction indicated by arrow 56, cryogen from tank 10 is drawn into chamber 36*b* through inlet line 46*b* and inlet check valve 48*b* by the resulting suction. After the pumping piston 30 reaches the top of its stroke, and begins to travel downward in the direction opposite arrow 56, cryogen is drawn into chamber 36*a* through inlet line 46*a* and inlet check valve 48*a* due to the resulting suction. LNG is simultaneously forced from chamber 36*b* and, due to the action of the check valves 48*b* and 52*b*, through outlet line 54*b*. When the pumping piston reaches the bottom of its stroke and begins to travel upward again, in the direction of arrow 56, LNG is forced from chamber 36*a* and, due to the action of check valves 48*a* and 52*a*, through outlet line 54*a*.

The first and second pumping cylinder outlet lines 54*a* and 54*b*, respectively, converge at junction 58. As a result, the LNG pumped by pumping piston 30 may travel through either mixer LNG inlet line 62 or heat exchanger inlet line 64. LNG traveling through line 64 encounters ambient heat exchanger 66 and is converted into natural gas. The resulting natural gas flows through heat exchanger outlet line 68 to automated control valve 72 where it is directed to either chamber 24*a* or chamber 24*b* of the actuating cylinder.

Automated control valve 72 is configured by controller 75 to either direct natural gas flowing through line 68 into chamber 24*a* or 24*b*. Controller 75 determines the appropriate setting for the automated control valve 72 based upon the settings of limit switches 42*a* and 42*b*. More specifically, when limit switch 42*b* is set, valve 72 is configured to introduce natural gas into chamber 24*b* so that actuating piston 26 is propelled upward, in the direction of arrow 56. As a result, any gas in chamber 24*a* exits the actuating cylinder through the first actuating cylinder outlet line 74*a* and the first actuating cylinder outlet check valve 76*a*.

When actuating piston 26 and pumping piston 30 are at the top of their stroke, the stroke change cam 38 contacts, and thus trips, limit switch 42*a*. As a result, controller 75 reconfigures valve 72 to deliver natural gas to chamber 24*a* so that actuating piston 26 is propelled downward, in a direction opposite of arrow 56. Natural gas is thus forced out of chamber 24*b* through second actuating cylinder outlet line 74*b* and second actuating cylinder outlet check valve 76*b*.

The alternating introduction of natural gas into chambers 24*a* and 24*b* thus moves the actuating cylinder 26 up and down in a reciprocating fashion. Due to connecting rod 32, the pumping piston 30 is propelled by the motion of the actuating piston 26 and, as a result, LNG is pumped from storage tank 10. As such, pump 20 behaves basically like a steam engine with the heat exchanger 66 serving as a boiler. A pressurized supply of gas is maintained in a surge tank 82. The gas from surge tank 82 is introduced into chambers 24*a* and 24*b* in an alternating fashion by valve 72 when the system is at rest to initiate the operation of pump 20.

Hydraulic cylinder 402 receives pressurized hydraulic fluid from a source (not shown) through line 410. Hydraulic fluid flowing towards the hydraulic cylinder through line 410 encounters an automated control valve 412. Depending on the setting of valve 412, the hydraulic fluid travels either to hydraulic cylinder chamber 406*a* or 406*b* through lines 414*a* or 414*b*, respectively. The provision of hydraulic fluid to chamber 406*a* causes piston 408 to travel downwards while hydraulic fluid flowing to chamber 406*b* causes piston 408 to travel upwards. As piston 408 travels downwards, hydraulic fluid forced from chamber 406*b* travels through check valve 418*b* and line 420 whereby it is returned to the hydraulic fluid source. Conversely, as piston 408 travels upwards, hydraulic fluid forced from chamber 406*a* travels through check valve 418*a* to line 420.

Hydraulic piston 408 is connected to actuating piston 26 via supplemental actuator connecting rod 416. As a result, hydraulic piston 408 assists actuating piston 26 in driving pumping piston 30. Connecting rod 416 may be a component that is separate from connecting rod 32, or, alternatively, connecting rods 416 and 32 together may form a single, one-piece connecting rod. The setting of valve 412 is dictated by controller 75. As with valve 72, valve 412 is configured to deliver hydraulic fluid to the lower chamber 406*b* when the stroke change cam 38 trips limit switch 42*b*. Controller 75 reconfigures valve 412 to deliver hydraulic fluid to upper chamber 406*a* when the stroke change cam 38 trips limit switch 42*a*. As a result, the hydraulic cylinder 402 is synchronized with the remaining portions of pump 20.

Hydraulic cylinders are available in a range of standard sizes including, for example, cylinder diameters of 1.5, 2, 2.5, 3.25, 4, or 5 inches. The size selection of the hydraulic cylinder depends on the force required to be generated by hydraulic cylinder and the hydraulic pressure available to power it (typically 1000–5000 psi). As an example only, a 4 in. bore pump (pumping cylinder 35 of FIG. 1 having a 4 in. diameter) may be driven by the combination of a 5.5 in. diameter actuating cylinder and a 3.25 in. hydraulic cylinder to a discharge pressure of 4200 psi or more. As mentioned previously, however, alternative types of linear actuators may be used in place of hydraulic cylinder 402.

Natural gas exiting the actuating cylinder 23 and traveling through lines 74*a* and 74*b* and check valves 76*a* and 76*b* flows through junction 84 and into mixer gas inlet line 86 to gas and liquid mixer 88. Gas and liquid mixer 88 also receives LNG from mixer LNG inlet line 62. The warmer gas from line 86 combines with the cooler LNG from line 62 in mixer 88 so that the LNG is warmed and delivered or dispensed through conditioned liquid dispensing line 92. While a variety of gas and liquid mixers known in the art are suitable for use with the system of the present invention, gas and mixer 88 preferably is partially filled with LNG from line 62 and the natural gas from line 86 is bubbled therethrough.

The degree of heating of the LNG in the gas and liquid mixer 88 is directed by the requirements of the use device or process to which the LNG is delivered or dispensed. For example, LNG dispensed to a vehicle is typically conditioned so that it is saturated at the pressure required by the vehicle's engine.

The temperature of the LNG delivered through line 92 is dictated by the quantities of LNG and natural gas delivered to mixer 88 through lines 62 and 86, respectively. Accordingly, mixer LNG inlet line 62 is equipped with a pressure control circuit 94. When pressure control circuit 94 is adjusted to provide increased pressure in line 62, more of the LNG encountering junction 58 travels through heat exchanger inlet line 64 (the path of least resistance). The more LNG that travels through line 64, and thus through heat exchanger 66 and the actuating cylinder, the greater the heating of the LNG traveling to mixer 88. Increasing the pressure in line 62 via circuit 94 also increases the operating speed of pump 20. Conversely, adjusting pressure control circuit 94 so that the pressure in line 62 is decreased results in less heating of the LNG in mixer 88 and a lower operating speed of pump 20.

The heating of the LNG in mixer 88 is also effected by the choice of diameter of the actuating and pumping pistons, illustrated at 102 and 104, respectively. A larger actuating piston diameter and/or a smaller pumping piston diameter requires more gas to pump a given quantity of LNG. Greater gas usage by the actuating cylinder equates to greater heating of the LNG in mixer 88 as the ratio of the quantity of gas exiting the actuating cylinder (and traveling to the mixer) to the quantity of LNG exiting the pumping cylinder increases. As such, the requirements of the process or use device to which the LNG is dispensed or delivered is considered when selecting the diameters of the actuating and pumping pistons and, therefore, the diameters of the actuating and pumping cylinders.

The dispensing line 92 may optionally be equipped with an adjustable flow valve 106. Valve 106 may be used to restrict the flow of conditioned LNG through line 92. When the flow through line 92 is restricted, more pressure is required by pump 20 to pump the conditioned LNG from mixer 88. The increased pressure requirement translates into a greater quantity of gas required per stroke of the actuating and pumping pistons. The greater quantity of gas used by the actuating cylinder and piston travels to the mixer 88 to provide greater heating of the LNG therein. Increasing the flow resistance through dispensing line 92 is therefore yet another way to increase the heating of the LNG in mixer 88.

Figure 2:
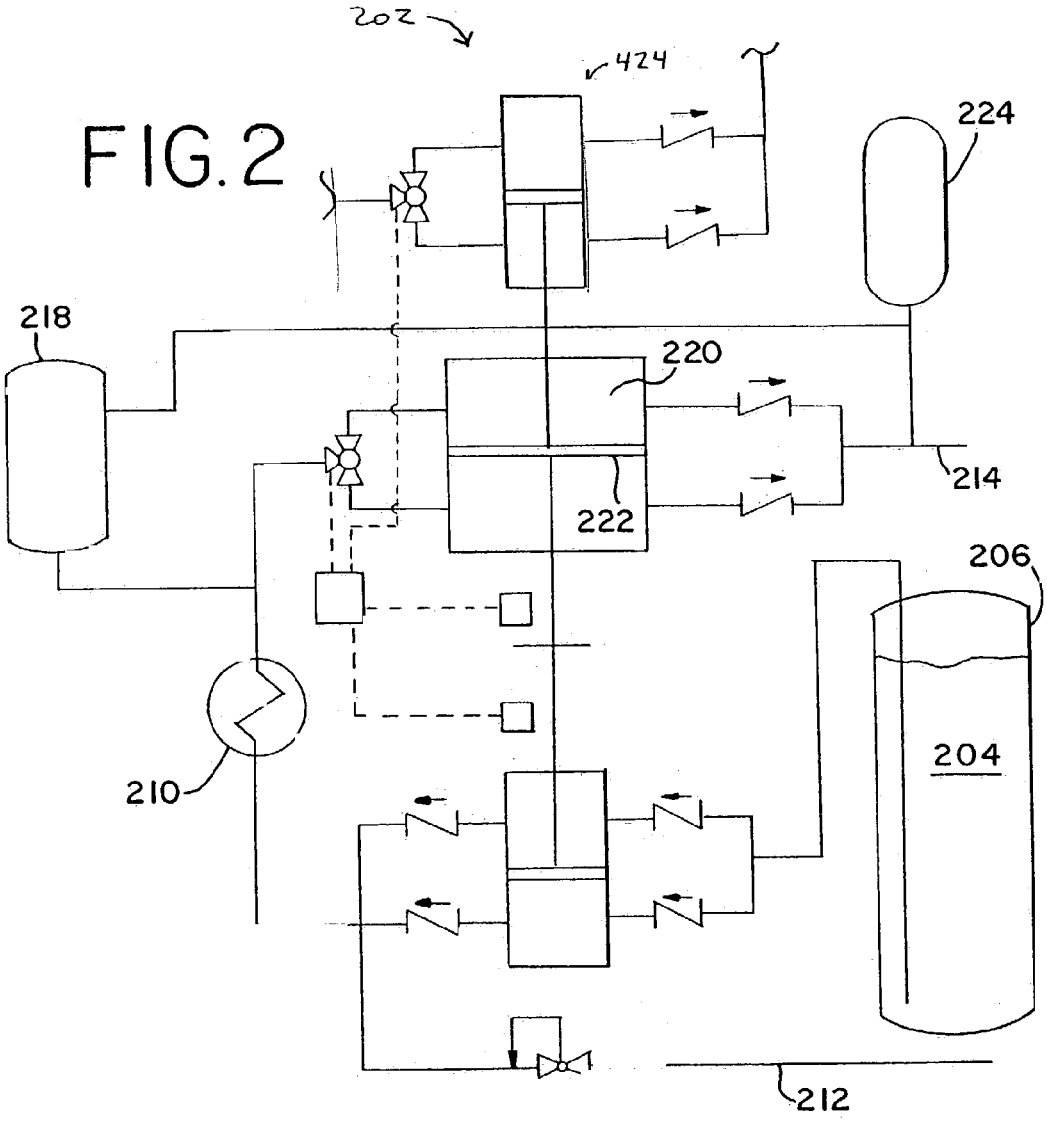
FIG. 2 is a schematic diagram of an alternative embodiment of the system of the present invention.

An alternative embodiment of the system of the present invention is illustrated in FIG. 2. The system of FIG. 2 is identical to the system of FIG. 1 with the exception that the mixer 88 has been removed. As a result, the pump of the system of FIG. 2, indicated in general at 202, operates in the same manner as the pump 20 of FIG. 1. In addition, the system of FIG. 2 also withdraws LNG 204 from a tank 206 and vaporizes a portion of it with a heat exchanger 210 to power the pump with assistance from hydraulic cylinder 424. Instead of conditioning the LNG, however, the system of FIG. 2 dispenses unconditioned LNG through LNG delivery line 212.

The system of FIG. 2 also may vent, dispense or deliver natural gas through gas delivery line 214. As with the system of FIG. 1, gas from a surge tank 218 is delivered to the actuating cylinder 220 of the pump 202 to initiate movement of the pump actuating piston 222. Gas from the delivery line 214 may be routed to the surge tank 218 so that the surge tank is recharged for future use. Alternatively, or in addition, natural gas from delivery line 214 may be routed to a natural gas storage tank 224 for use in another process or application.

Figure 3:
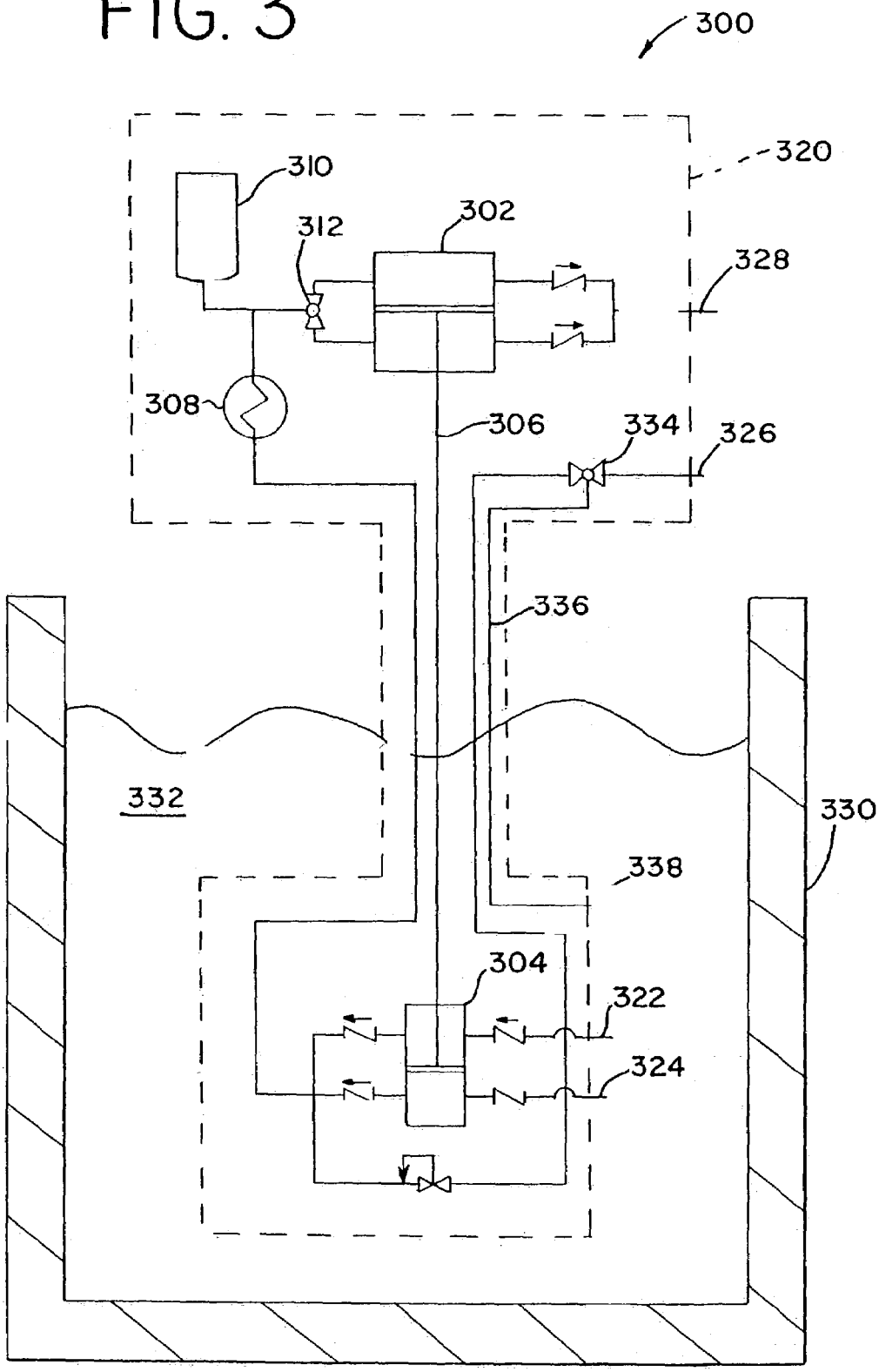
FIG. 3 is a schematic diagram of a portable pump embodiment of the system of the present invention.

A portable pump embodiment of the system of the present invention is illustrated in FIG. 3. The pump of FIG. 3, indicated in general at 300, operates in the same fashion as pumps 20 and 202 of FIGS. 1 and 2, respectively, with the exception that the hydraulic cylinder supplemental linear actuator has been removed A hydraulic cylinder or other linear actuator may optionally be added to the portable pump of FIG. 3 to increase the pump's discharge pressure. As with the pumps of FIGS. 1 and 2, the pump 300 includes an actuating housing 302, pumping housing 304, connecting rod 306, heat exchanger 308 and surge tank 310. Automated control valve 312 of the pump is preferably also controlled by the cam and switch arrangement of FIGS. 1 and 2, which has been omitted from FIG. 3 for the sake of clarity. The components of portable pump 300 are positioned within a housing 320 which features liquid inlets 322 and 324 and pressurized liquid outlet 326 and pressurized gas outlet 328.

As illustrated in FIG. 3, portable pump may be simply and conveniently placed into a container of cryogen, such as open mouth dewar 330 of FIG. 3. Pump 300, when activated, takes in the liquid 332 within the dewar through inlets 322 and 324 in an alternating fashion and, as described with regard to FIGS. 1 and 2, uses ambient heat and the cryogen to power the pump and provide pressurized gas at 328 or liquid at 326. With regard to the latter, valve 334 must be configured to enable the pressurized liquid to flow to outlet 326. Otherwise, valve 334 directs the pumped liquid through recirculation line 336 and outlet 338 back into the dewar 330. The pump may optionally be fitted with the gas and liquid mixer 88 of FIG. 1 so that the gas and liquid outlets 328 and 326 lead thereto so that heated cryogen is provided.

Figure 4:
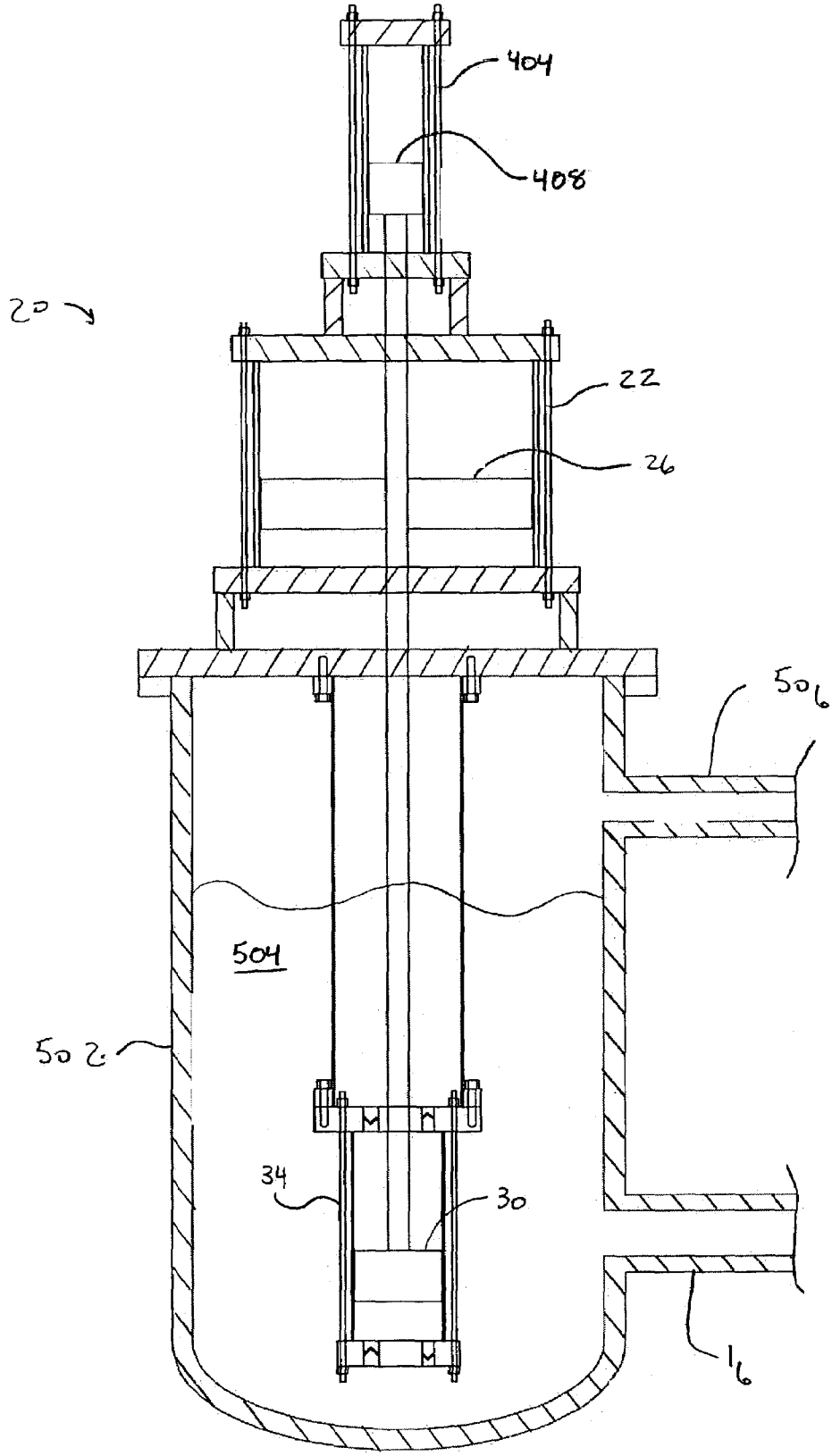
FIG. 4 is an enlarged sectional view of an embodiment of the pump of the systems of FIGS. 1 and 2.

As illustrated in FIG. 4, the pump 20 of FIG. 1 may be constructed so that the pumping cylinder housing 34 is positioned in a sump 502 so as to be submerged in liquid cryogen 504. The sump 502 receives liquid cryogen from the tank 10 of FIG. 1 through inlet line 16. Displaced vapor and any liquid overflow from sump 502 return to the headspace of tank 10 (FIG. 1) through outlet line 506.

Keeping the liquid side or "cold end" of the pump submerged in cryogen eliminates the need for pump cool-down prior to dispensing. More specifically, the pumping piston 30 and housing 34 would vaporize liquid cryogen if they were permitted to become warm between uses of the pump. Keeping the pumping piston and cylinder cool therefore eliminates the two-phase flow through the pump that could otherwise occur. The pump 202 of FIG. 2, respectively, may also be constructed with their pumping cylinder housing disposed in a sump containing cryogenic liquid.

As illustrated in FIG. 4, the actuating cylinder housing 22 may be mounted on top of the sump 502 and the hydraulic cylinder housing 404 may be mounted to the top of the actuating cylinder housing 22. This permits the pump 20 to have a compact and rugged construction.

While the preferred embodiments of the invention have been shown and described, it will be apparent to those skilled in the art that changes and modifications may be made therein without departing from the spirit of the invention, the scope of which is defined by the appended claims.

What is claimed is:

1. A cryogenic fluid delivery system comprising:

a. a storage tank containing a supply of cryogenic liquid;

b. a pump including:

i) a pumping cylinder having an inlet in communication with said storage tank, an outlet and a pumping piston slidingly positioned therein so that cryogenic liquid from the storage tank is pumped through the pumping cylinder outlet by motion of the pumping piston;

ii) an actuating cylinder having an inlet, an outlet and an actuating piston slidingly positioned therein;

iii) a supplemental linear actuator;

iv) said supplemental linear actuator, actuating piston and pumping piston joined by at least one connecting rod so that the pumping piston is driven by the actuating piston and the supplemental linear actuator;

c. a heat exchanger in circuit between the pumping cylinder outlet and the actuating cylinder inlet, said heat exchanger vaporizing a-portion of the pumped cryogenic liquid so that said actuating piston is propelled by the resulting cryogenic vapor; and d. a liquid delivery line also in communication with the pumping cylinder outlet so that a portion of the pumped cryogenic liquid may be delivered therethrough.

2. The system of claim 1 wherein the supplemental linear actuator is a hydraulic cylinder.

3. The system of claim 1 further comprising a pressure control circuit positioned within said liquid delivery line, said pressure control circuit selectively increasing the pressure within said liquid delivery line so that a greater portion of pumped cryogenic liquid may be directed to said heat exchanger.

4. The system of claim 1 further comprising:

e. a gas and liquid mixer in communication with the actuating cylinder outlet and the liquid delivery line so that said gas and liquid mixer receives cryogenic liquid from the liquid delivery line and cryogenic vapor from the actuating cylinder outlet so that the cryogenic liquid is warmed by the cryogenic vapor to a desired temperature; and f. a conditioned liquid dispensing line also in communication with the gas and liquid mixer so that the warmed cryogenic liquid may be dispensed therefrom.

5. The system of claim 4 further comprising a pressure control circuit positioned in said liquid delivery line, said pressure control circuit selectively increasing the pressure within said liquid delivery line so that a greater portion of the pumped cryogenic liquid may vaporized and ultimately directed to said gas and liquid mixer so that greater heating of the cryogenic liquid occurs therein.

6. The system of claim 1:

wherein said actuating cylinder is divided by said actuating piston into a first chamber and a second chamber, each of which includes an inlet; and further comprising a first automated control valve in circuit between the heat exchanger and the actuating cylinder inlets, said first automated control valve introducing cryogenic vapor into said first and second actuating cylinder chambers in an alternating fashion thereby propelling the actuating piston in the first and second directions in a reciprocating fashion.

7. The system of claim 6:

wherein said supplemental linear actuator is a hydraulic cylinder including a hydraulic piston attached to the connecting rod with first and second chambers on opposing sides of the hydraulic piston, each of which includes an inlet; and further comprising a second automated control valve adapted to communicate with a pressurized source of hydraulic fluid and the hydraulic cylinder first and second chamber inlets, said second automated control valve introducing hydraulic fluid into said hydraulic cylinder first and second chambers in an alternating fashion thereby propelling the hydraulic piston in the first and second directions in a reciprocating fashion.

8. The system of claim 7 further comprising first and second limit switches, a stroke change cam attached to said connecting rod and a controller, said controller in communication with the first and second automated control valves and the first and second limit switches, said stroke change cam tripping said first limit switch when said actuating, hydraulic and pumping pistons have traveled to a first position and said stroke change cam tripping the second limit switch when said actuating, hydraulic and pumping pistons have traveled to a second position, said controller reconfiguring said first and second automated control valves whenever said first and second limit switches are tripped so that cryogenic vapor is redirected to a different chamber of the actuating cylinder and hydraulic fluid is redirected to a different chamber of the hydraulic cylinder.

9. The system of claim 1:

wherein said supplemental linear actuator is a hydraulic cylinder including a hydraulic piston attached to the connecting rod with first and second chambers on opposing sides of the hydraulic piston, each of which includes an inlet; and further comprising an automated control valve adapted to communicate with a pressurized source of hydraulic fluid and the hydraulic cylinder first and second chamber inlets, said automated control valve introducing hydraulic fluid into said hydraulic cylinder first and second chambers in an alternating fashion thereby propelling the hydraulic piston in the first and second directions in a reciprocating fashion.

10. The system of claim 9 further comprising first and second limit switches, a stroke change cam attached to said connecting rod and a controller, said controller in communication with the automated control valve and the first and second limit switches, said stroke change cam tripping said first limit switch when said actuating, hydraulic and pumping pistons have traveled to a first position and said stroke change cam tripping the second limit switch when said actuating, hydraulic and pumping pistons have traveled to a second position, said controller reconfiguring said automated control valve whenever said first and second limit switches are tripped so that hydraulic fluid is redirected to a different chamber of the hydraulic cylinder.

11. A pump for transferring cryogenic fluid from a storage tank comprising:

a. a pumping cylinder housing defining a pumping cylinder, said pumping cylinder having an inlet adapted to communicate with said storage tank, an outlet and a pumping piston slidingly positioned therein so that cryogenic liquid from the storage tank is pumped through the pumping cylinder outlet by motion of the pumping piston;

b. an actuating cylinder housing defining an actuating cylinder, said actuating cylinder having an inlet, an outlet and an actuating piston slidingly positioned therein;

c. a heat exchanger in circuit between the pumping cylinder outlet and the actuating cylinder inlet, said heat exchanger vaporizing a portion of the pumped cryogenic liquid so that said actuating piston is propelled by the resulting cryogenic vapor;

d. a supplemental linear actuator; and e. said actuating piston, supplemental linear actuator and pumping piston joined by at least one connecting rod so that the pumping piston is driven by the actuating piston and the supplemental linear actuator.

12. The pump of claim 11 further comprising a sump containing a supply of cryogenic liquid with said pumping cylinder housing submerged in the supply of cryogenic liquid.

13. The pump of claim 11 further comprising a liquid delivery line also in communication with the pumping cylinder outlet and adapted to communicate with a use device so that a portion of the pumped cryogenic liquid may be delivered to the use device.

14. The pump of claim 13 further comprising a pressure control circuit positioned within said liquid delivery line, said pressure control circuit selectively increasing the pressure within said liquid delivery line so that a greater portion of pumped cryogenic liquid may be directed to said heat exchanger.

15. The pump of claim 13 further comprising:

e. a gas and liquid mixer in communication with the actuating cylinder outlet and the liquid delivery line so that said gas and liquid mixer receives cryogenic liquid from the liquid delivery line and cryogenic vapor from the actuating cylinder outlet so that the cryogenic liquid is warmed by the cryogenic vapor to a desired temperature; and f. a conditioned liquid dispensing line also in communication with the gas and liquid mixer so that the warmed cryogenic liquid may be dispensed therefrom.

16. The pump of claim 15 further comprising a pressure control circuit positioned in said liquid delivery line, said pressure control circuit selectively increasing the pressure within said liquid delivery line so that a greater portion of the pumped cryogenic liquid may vaporized and ultimately directed to said gas and liquid mixer so that greater heating of the cryogenic liquid occurs therein.

17. The pump of claim 11:

wherein said actuating cylinder is divided by said actuating piston into a first chamber and a second chamber, each of which includes an inlet; and further comprising a first automated control valve in circuit between the heat exchanger and the actuating cylinder inlets, said first automated control valve introducing cryogenic vapor into said first and second actuating cylinder chambers in an alternating fashion thereby propelling the actuating piston in the first and second directions in a reciprocating fashion.

18. The pump of claim 17:

wherein said supplemental linear actuator is a hydraulic cylinder including a hydraulic piston attached to the connecting rod with first and second chambers on opposing sides of the hydraulic piston, each of which includes an inlet; and further comprising a second automated control valve adapted to communicate with a pressurized source of hydraulic fluid and the hydraulic cylinder first and second chamber inlets, said second automated control valve introducing hydraulic fluid into said hydraulic cylinder first and second chambers in an alternating fashion thereby propelling the hydraulic piston in the first and second directions in a reciprocating fashion.

19. The system of claim 18 further comprising first and second limit switches, a stroke change cam attached to said connecting rod and a controller, said controller in communication with the first and second automated control valves and the first and second limit switches, said stroke change cam tripping said first limit switch when said actuating, hydraulic and pumping pistons have traveled to a first position and said stroke change cam tripping the second limit switch when said actuating, hydraulic and pumping pistons have traveled to a second position, said controller reconfiguring said first and second automated control valves whenever said first and second limit switches are tripped so that cryogenic vapor is redirected to a different chamber of the actuating cylinder and hydraulic fluid is redirected to a different chamber of the hydraulic cylinder.

20. The pump of claim 11:

wherein said supplemental linear actuator is a hydraulic cylinder including a hydraulic piston attached to the connecting rod with first and second chambers on opposing sides of the hydraulic piston, each of which includes an inlet; and further comprising an automated control valve adapted to communicate with a pressurized source of hydraulic fluid and the hydraulic cylinder first and second chamber inlets, said automated control valve introducing hydraulic fluid into said hydraulic cylinder first and second chambers in an alternating fashion thereby propelling the hydraulic piston in the first and second directions in a reciprocating fashion.

* * * * *